United States Patent [19]

Klawitter

[11] 4,251,947

[45] Feb. 24, 1981

[54] ILLUSION TOY

[75] Inventor: Ronald R. Klawitter, Gasconade County, Mo.

[73] Assignee: Steven Manufacturing Company, Hermann, Mo.

[21] Appl. No.: 109,232

[22] Filed: Jan. 3, 1980

[51] Int. Cl.[3] ..... A63H 33/00

[52] U.S. Cl. ..... 46/1 R; 46/47; 272/8 N

[58] Field of Search ..... 46/1 R, 47, 48, 49; 272/8 N, 8 R, 8 D

[56] References Cited

U.S. PATENT DOCUMENTS 1,914,938 6/1933 Boninger ..... 272/8 N

*Primary Examiner*—Gene Mancene
*Assistant Examiner*—Mickey Yu
*Attorney, Agent, or Firm*—Polster, Polster and Lucchesi

[57] ABSTRACT

An illusion toy has an upper compartment in which a figure with sword or wand in hand appears to strike through a solid neck, and a lower compartment in which the mechanism for rotating the sword or wand is housed. The upper compartment has a cover on it with a hole to receive the neck. The neck has a head on its outer end, which, larger than the hole, remains on the outside of the cover. The neck can be withdrawn through the hole, and remounted at will. The mechanism includes a shaft that carries on its upper end the wand or sword, a pinion or the lower end of the shaft that is turned by an arcuate segment rack, and a spring biased overcenter mechanism to flip the sword or wand through more than 270°, in response to the manipulation of a handle, at such a rapid rate that the sword or wand appears to traverse an arc through the neck instead of moving in the opposite direction.

1 Claim, 4 Drawing Figures

ILLUSION TOY

BACKGROUND OF THE INVENTION

The present invention is an improvement on the devices known heretofore in which a solid wand or sword is made to appear to pass through a solid obstacle without displacing or cutting the obstacle. The device of this invention is simple and economical to manufacture, and is attractive.

SUMMARY OF THE INVENTION

In accordance with this invention, generally stated, an illusion toy is provided with a housing having a side wall defining a bounded area, the side wall having an elongated slot extending perimetrically, a transparent cover coextensive with the bounded area, the cover having an aperture in it, and a picture-bearing partition spaced from and below the transparent cover. A bottom closure defines with the side wall and partition a mechanism compartment below the partition. The partition has a shaft opening in it, offset from the cover aperture. A head and neck unit is mountable and demountable on the cover. The neck is dimensioned to fit through the aperture and the head, being larger than the aperture, remains on the outside of the cover. An illusion producing mechanism has a shaft extending through the shaft opening in the partition into the space between the partition and the cover. The shaft carries at its upper end a wand, extending radially from the shaft a distance greater than the distance between the shaft and the cover aperture, hence beyond the neck when it is mounted on the cover. A pinion is connected to the lower end of the shaft and engages an arcuate segment rack. A lever projects through and beyond the side wall slot and is connected to an overcenter mechanism of which the segment rack and pinion are a part. The overcenter mechanism preferably includes a quadrant yoke mounted on a pivot within the compartment with arms between the outer ends of which the segment rack extends, an intermediate rail extending between the arms between the segment rack and the pivot, and spaced from both. The intermediate rail has a central seat facing the pivot. The lever is pivotally mounted on the same pivot as the quadrant yoke and has a spring retainer on its inner end. A spring is mounted at one end on the lever spring retainer and at its other end on the intermediate rail central seat.

DESCRIPTION OF THE PREFERRED EMBODIMENT

Figure 1:
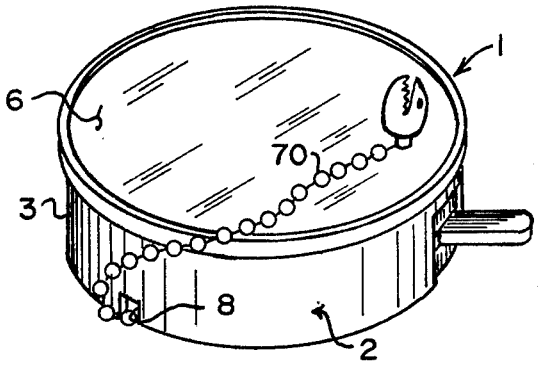
FIG. 1 is a view in perspective of one embodiment of illusion toy of this invention.

In the drawing reference numeral 1 indicates the assembled illusion toy, which has a cylindrical housing 2 made up of a side wall 3, with a perimetric slot 4 in it, a transparent cover 6 with a neck hole 7 in it, and a bottom wall 18, in this embodiment integral with the side wall 3. The bottom wall has a bearing hole 40 in its center. The side wall 3 also has in this embodiment a chain-receiving notch 8 in it.

A partition 10, with a central shaft aperture 11 and a neck aperture 12 in it is seated on piers 13 integral with the inside surface of the side wall 3. The partition 10 has on its upper surface a picture, in this illustrative embodiment, a shark 15 and Neptune or a diver 16, the latter with a hand encircling the central shaft aperture 11. The side wall 3, bottom 18 and partition 10 define a compartment 19. A hollow post 20, integral with the bottom wall, serves three functions, that of a pivot shaft, a neck receiving and engaging boss and a support and spacer for the partition 10. A central passage in the post is defined by the inner wall 21. Also formed integrally with the inner surface of the bottom wall 18 are stops 24 and chain anchoring fingers 23.

The side wall 3, partition 10 and cover 6 define an upper compartment 25.

A head and neck unit 26 consists of a head 27, in this embodiment simulating a shark's head, and a neck 28. The neck is small enough to fit easily within the aperture 7 in the cover, and to engage the passage defining wall 21 in a light friction fit. It is long enough to extend from the top of the cover to a place well within, but not through the post 20. In this embodiment one end of a chain 70 is attached to the head 27, and the other end is mounted between the fingers 23, where it is caged between the bottom wall and the partition 10. As is evident from the drawing, the head 27 is large compared with the opening 7, so as to remain on the outside of the cover when the neck is mounted in the post 20. The head is also large enough to permit it to be grasped easily, to permit a child to remove the head and neck from the housing.

Also in the upper compartment 25 is a wand 30, in the shape and appearance of a sword. The wand 30 has a hub 32 with a center socket 33, which fits tightly on the end of a stub shaft 35 that projects through the shaft aperture 11 and into the compartment 25.

Figure 3:
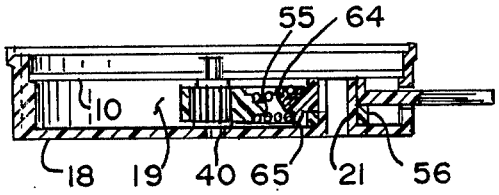
FIG. 3 is a sectional view taken along the line 3—3 of FIG. 2 with the lever partly broken away.
Figure 4:
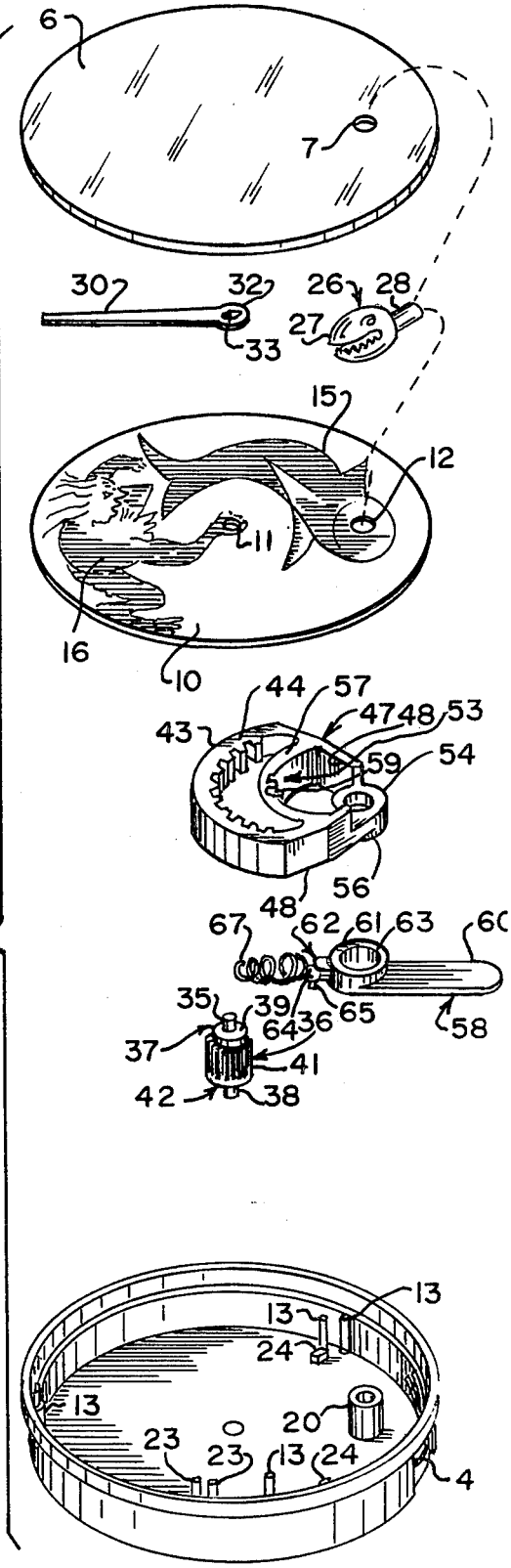
FIG. 4 is an exploded view in perspective showing the various parts making up the illustrative embodiment.

In this embodiment, the stub shaft 35 is integral with a plastic pinion 36. The pinion 36 has a cylindrical body 37 from which the stub shaft 35 projects at one end and a lower stub shaft 38 from the other. The lower stub shaft is revolvably journalled in the bearing hole 40. Upper and lower radial surfaces 39 serve as bearing surfaces. The pinion 36 has pinion teeth 41 which engage teeth 43 of a segment rack 44. A flange 42 projecting from the cylindrical body 37 serves the double function of supporting the segment rack 44 and precluding upward shifting of the teeth 41 with respect to the segment rack. The segment rack 44 is part of a quadrant yoke 47 which includes arms 48 and intermediate rail 51 curved complementarily to and spaced from the segment rack 44, extending between the arms 48, and a pivot journal with a rim 56 projecting below and designed to provide clearance for the lower planar surface of the quadrant yoke but stepped with respect to the upper surface, as shown in FIGS. 3 and 4. The pivot journal has a central opening defining sleeve 54 to permit the quadrant yoke to be mounted on the pivot 20. On the concave surface of the intermediate rail, a central seat 52, which in this embodiment consists of a shallow channel with a nose 55 projecting from it toward the center line of the sleeve 54, is provided.

In this embodiment, the entire quadrant yoke is molded as a unit from a suitable plastic.

A lever 58 has a handle portion 60, a knuckle 61 in the form of an annular sleeve defining an opening 63, and a spring retaining projection 62, which in this embodiment includes a finger 64 and a guide 65. Like the quadrant yoke, the lever is molded of one piece of plastic.

A helical spring 67 embraces the finger 64 of the lever at one end and the nose 55 on the intermediate rail 51 at its other.

Figure 2:
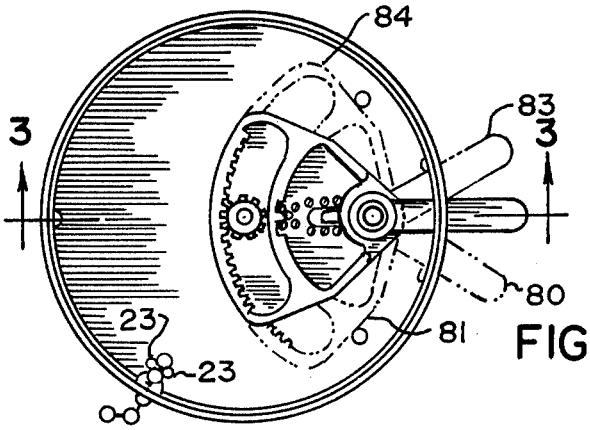
FIG. 2 is a top plan view with the platform and wand removed to show operating mechanism.

In operation, the lever is moved from one side to another. In the position shown at 80 in FIG. 2, the quadrant yoke is in the position 81. If now the handle is moved to the position shown in 83, the yoke will snap into the position shown in 84. The position shown in solid lines is an intermediate position which the handle and yoke never assume concurrently. When the handle is moved from the position shown at 80 to the position shown at 83, the movement of the segment rack clockwise as shown in FIG. 2 causes the pinion 36 to rotate in a clockwise direction as viewed in FIG. 2, which causes the wand 30 to move clockwise from a position below the neck 28 to a position above the neck 28. This movement, however, is so rapid as to deceive the eye, making it appear as if the wand moves through the neck to a position immediately on the other side. When the handle is moved in the opposite direction, the rack flips to the opposite end and the wand appears to pass through the neck in the other direction.

Numerous variations in the construction of the illusion toy of this invention within the scope of the appended claims will occur to those skilled in the art in the light of the foregoing disclosure. Merely by way of example, different pictures can be displayed on the platform. The segment rack and lever can be inverted, and with minor modification the handle can be differently shaped.

Having thus described the invention, what is claimed and desired to be secured by Letters Patent is:

1. In an illusion toy including a housing having a side wall defining a bounded area, said side wall having an elongated slot extending perimetrically, a transparent cover coextensive with said bounded area, said cover having an aperture in it, a picture bearing partition spaced from and below said transparent cover, and a bottom closure defining with said side wall and partition a mechanism compartment below said partition, said partition having a shaft opening in it, offset from said cover aperture, a head and neck unit, said head being larger than said cover aperture and said neck being dimensioned to fit through said aperture to extend through the space between the cover and the partition, and an illusion producing mechanism having a shaft extending perpendicularly to said partition through said shaft opening into the space between the partition and the cover, said shaft carrying at is upper end a wand oriented parallel to said partition and extending radially from said shaft a distance greater than the distance between the shaft and said cover aperture, hence beyond said neck, the improvement comprising a pinion connected to the lower end of said shaft and axially aligned therewith, an arcuate segment rack engaging said pinion, a lever projecting through and beyond said side wall slot, and overcenter means operatively connected to said lever and said segment rack for rapidly and suddenly displacing said rack in response to movement of said lever through a given arc past an overcentered position, whereby said shaft, hence said wand, is rapidly rotated from a position on one side of said neck to a position to the other side thereof, said overcenter means including a quadrant yoke mounted on a pivot within said compartment, said quadrant yoke having arms between the outer ends of which the segment rack extends, an intermediate rail extending between said arms between the said segment rack and said pivot and spaced from both, said intermediate rail having a central seat facing said pivot, said lever being pivotally mounted on the same pivot as the quadrant yoke and having a spring retainer on its inner end, and a spring mounted at one end on said lever spring retainer and at its other on said intermediate seat.

* * * * *